US008947069B2

(12) United States Patent
Fort et al.

(10) Patent No.: US 8,947,069 B2
(45) Date of Patent: Feb. 3, 2015

(54) METHOD AND DEVICE FOR GENERATING AN ADJUSTABLE BANDGAP REFERENCE VOLTAGE

(75) Inventors: Jimmy Fort, Puyloubier (FR); Thierry Soude, Marseilles (FR)

(73) Assignee: STMicroelectronics (Rousset) SAS, Rousset (FR)

( * ) Notice: Subject to any disclaimer, the term of this patent is extended or adjusted under 35 U.S.C. 154(b) by 263 days.

(21) Appl. No.: 13/472,731

(22) Filed: May 16, 2012

(65) Prior Publication Data

US 2012/0293143 A1 Nov. 22, 2012

(51) Int. Cl.

| | |
|---|---|
| ***G05F 3/16*** | (2006.01) |
| ***G05F 3/20*** | (2006.01) |
| ***G05F 3/30*** | (2006.01) |

(52) U.S. Cl.

CPC ..... *G05F 3/30* (2013.01)
USPC ..... 323/316; 323/313; 323/314; 323/315; 327/539

(58) Field of Classification Search

CPC ..... G05F 3/30
USPC ..... 323/313–316; 327/538–544
See application file for complete search history.

(56) References Cited

U.S. PATENT DOCUMENTS

| | | | | |
|---|---|---|---|---|
| 5,559,425 | A * | 9/1996 | Allman | 323/315 |
| 6,002,243 | A * | 12/1999 | Marshall | 323/313 |
| 6,002,244 | A * | 12/1999 | Wrathall | 323/315 |
| 6,016,051 | A * | 1/2000 | Can | 323/315 |
| 6,799,889 | B2 * | 10/2004 | Pennock | 374/178 |
| 7,199,646 | B1 * | 4/2007 | Zupcau et al. | 327/539 |
| 7,236,048 | B1 * | 6/2007 | Holloway et al. | 327/539 |
| 7,944,271 | B2 * | 5/2011 | Illegems | 327/513 |
| 8,456,235 | B2 * | 6/2013 | Tachibana et al. | 330/253 |
| 8,558,530 | B2 * | 10/2013 | Pulijala et al. | 323/314 |
| 2005/0077954 | A1 * | 4/2005 | Illegems | 327/541 |

(Continued)

FOREIGN PATENT DOCUMENTS

EP 0895147 A1 2/1999

OTHER PUBLICATIONS

Banba, H. et al., "A CMOS Bandgap Reference Circuit with Sub-1-V Operation," IEEE Journal of Solid-State Circuits, vol. 34, No. 5, May 1999, 5 pp.

(Continued)

*Primary Examiner* — Timothy J Dole
*Assistant Examiner* — Yusef Ahmed
(74) *Attorney, Agent, or Firm* — Slater & Matsil, L.L.P.

(57) ABSTRACT

According to an embodiment, generating an adjustable bandgap reference voltage includes generating a current proportional to absolute temperature (PTAT). Generating the PTAT current includes equalizing voltages across the terminals of a core that is designed to be traversed by the PTAT current. Generating the adjustable bandgap reference also includes generating a current inversely proportional to absolute temperature (CTAT), summing the PTAT and the CTAT currents and generating the bandgap reference voltage based on the sum of the currents. Equalizing includes connecting-across the terminals of the core a first fed-back amplifier with at least one first stage arranged as a folded setup and including first PMOS transistors arranged according to a common-gate setup. Equalizing also includes biasing the first stage based on the CTAT current. The summation of the PTAT and CTAT currents is performed in the feedback stage of the first amplifier.

13 Claims, 3 Drawing Sheets

(56) References Cited

U.S. PATENT DOCUMENTS

| | | | | |
|---|---|---|---|---|
| 2006/0197584 | A1* | 9/2006 | Hsu | 327/539 |
| 2006/0261882 | A1* | 11/2006 | Johnson | 327/539 |
| 2006/0268629 | A1* | 11/2006 | Senouci et al. | 365/189.09 |
| 2007/0076483 | A1 | 4/2007 | Colman | |
| 2008/0061863 | A1* | 3/2008 | De Barros Soldera et al. | 327/512 |
| 2009/0243708 | A1* | 10/2009 | Marinca | 327/539 |
| 2009/0243711 | A1* | 10/2009 | Marinca | 327/541 |
| 2009/0243713 | A1* | 10/2009 | Marinca | 327/542 |
| 2009/0295360 | A1* | 12/2009 | Hellums | 323/315 |
| 2010/0007324 | A1* | 1/2010 | Masson et al. | 323/313 |
| 2010/0073070 | A1* | 3/2010 | Ng et al. | 327/513 |
| 2010/0164608 | A1* | 7/2010 | Shin | 327/539 |
| 2010/0225384 | A1* | 9/2010 | Hirose et al. | 327/543 |
| 2011/0267133 | A1* | 11/2011 | Kumar | 327/512 |
| 2012/0293143 | A1 | 11/2012 | Fort et al. | |

OTHER PUBLICATIONS

Isikhan, T. et al., "A New Low Voltage Bandgap Reference Technology," IEEE 2009, pp. 183-186.

Lam, Y. et al., "CMOS Bandgap References with Self-Biased Symmetrically Matched Current-Voltage Mirror and Extension of Sub-1-V Design," IEEE Transactions on Very Large Scale Integration (VLSB Systems) vol. 18, No. 6, Jun. 2010, pp. 857-865.

Gray, P., "Analysis and Design of Analog Integrated Circuits," Fifth Edition, International Student Version, Feb. 15, 2001, 9 pp.

Chinese Office Action received in Application No. 201210160927.2 mailed Jan. 22, 2014, 8 pages.

French Search Report received in Application No. 1154268 mailed Feb. 2, 2012, 11 pages.

* cited by examiner

METHOD AND DEVICE FOR GENERATING AN ADJUSTABLE BANDGAP REFERENCE VOLTAGE

CROSS-REFERENCE TO RELATED APPLICATIONS

This application claims the priority benefit of French patent application number 1154268, filed May 17, 2011, entitled "Low Voltage High Performance Bandgap," which is hereby incorporated by reference to the maximum extent allowable by law.

TECHNICAL FIELD

The invention relates to the generation of a so-called bandgap reference voltage. A bandgap reference voltage is a voltage which is substantially independent of temperature, and devices generating such reference voltages are widely used in integrated circuits.

BACKGROUND

Generally, a circuit generating a bandgap voltage delivers an output voltage in the vicinity of 1.25 volts, near the bandgap value of silicon at the temperature of 0 degrees Kelvin which is equal to 1.22 eV.

In certain circuits, the value of the reference voltage delivered may be adjusted by the value of a resistor or a resistance ratio. One then speaks of an adjustable bandgap reference voltage.

In a general manner, the voltage difference between two PN junctions, for example diodes or bipolar transistors mounted in diode fashion, exhibiting different current densities, makes it possible to generate a current proportional to absolute temperature, generally known by the person skilled in the art by the name "PTAT Current", where the acronym PTAT stands for "Proportional To Absolute Temperature".

Moreover, the voltage across the terminals of a diode or of a transistor mounted in diode fashion traversed by a current such as a PTAT current, is a voltage comprising a term inversely proportional to absolute temperature and a second-order term, that is to say varying non-linearly with absolute temperature. Such a voltage is nonetheless designated by the person skilled in the art by the term voltage inversely proportional to absolute temperature and is generally known by the person skilled in the art by the name "CTAT voltage", where the acronym CTAT stands for "Complementary To Absolute Temperature". It is then possible to obtain a CTAT current on the basis of this CTAT voltage.

The so-called bandgap reference voltage may then be obtained on the basis of the sum of these two currents through an appropriate choice of the resistors in which these two currents flow, making it possible to cancel the contribution of the temperature factor for a given temperature, so as to render this so-called bandgap voltage independent of the temperature around the given temperature.

An exemplary circuit generating a bandgap reference voltage is described for example in the article by Hironori Banba et al., entitled "A CMOS Bandgap Reference Circuit with Sub-1-V Operation", IEEE Journal of Solid-State Circuits, Vol. 34, No. 5, May 1999, the relevant teaching of which is incorporated herein by reference.

Such a circuit comprises means for equalizing the voltages across the terminals of a core, comprising a resistor and, in the two branches of the core, two different numbers of diodes, the core then being traversed by an internal current proportional to absolute temperature (PTAT current). Lateral resistors are moreover connected between the terminals of the core and earth, and are then traversed by a current inversely proportional to absolute temperature (Ictat current). An output module is then designed to generate the bandgap output reference voltage.

The operation of the circuit with very low current consumption requires the use of a large resistive value for the lateral resistor generating the current, typically several megaohms. Moreover this resistor must be duplicated at each terminal of the core so as to balance the currents. This consequently results in a considerable occupied silicon area.

Another type of circuit delivering a bandgap voltage reference is described in the work by P. R. Gray, P. H. Hurst, S. H. Lewis and R. G. Meyer, entitled "Analysis and Design of Analog Integrated Circuits", $4^{th}$ edition, New York: Wiley, Chapter 4, pp. 326-327, the relevant teach of which is incorporated herein by reference. This circuit uses, in particular, cascoded current mirrors disposed between the power supply voltage and the branches of the core, so as to improve the power supply rejection rate. The PTAT current delivered by the core then flows in an additional lateral branch comprising a resistor connected in series with an additional bipolar transistor mounted as an additional diode. This consequently results, across the terminals of this additional resistor, in a potential difference proportional to absolute temperature.

Moreover, the resulting voltage across the terminals of the additional resistor-additional diode assembly is the sum of this voltage proportional to absolute temperature and of the emitter low voltage of the additional bipolar transistor which is, itself, inversely proportional to absolute temperature. An output module makes it possible to deliver a bandgap reference voltage as output.

However, such a circuit exhibits the drawback of requiring a relatively high power supply voltage because of the presence of cascoded current mirrors, stacked between the power supply terminal and the core.

SUMMARY OF THE INVENTION

In one aspect, embodiments of the present invention provide for a method for generating an adjustable bandgap reference voltage, The method includes generating a current proportional to absolute temperature, comprising equalizing the voltage across terminals of a core, the core configured to then be traversed by said current proportional to absolute temperature. The method further includes generating a current inversely proportional to absolute temperature, summing said current proportional to absolute temperature and said current inversely proportional to absolute temperature, and generating said bandgap reference voltage on the basis of the said sum of currents, The step of equalizing comprises connecting across the terminals of the core a first fed-back amplifier possessing at least one first stage arranged as a folded setup and comprising first PMOS transistors arranged according to a common-gate setup, and biasing said first stage on the basis of said current inversely proportional to absolute temperature. The step of summing is performed in the feedback stage of the first amplifier.

In another aspect, embodiments of the present invention provide for a device for generating an adjustable bandgap reference voltage. The device includes first means for generating a current proportional to absolute temperature comprising first processing means connected to terminals of a core and designed to equalize the voltages across the terminals of the core, and second means for generating a current inversely proportional to absolute temperature connected to the core.

The device further includes an output module designed to generate the reference voltage. The first processing means comprise a first amplifier possessing at least one first stage, biased on the basis of the current inversely proportional to absolute temperature, arranged according to a folded setup and comprising first PMOS transistors arranged according to a common-gate setup, and a feedback stage whose input is connected to the output of the amplifier and whose output is connected to the input of the first stage as well as to at least one terminal of the core, the feedback stage being intended to be traversed by an intermediate current equal to the sum of the current proportional to absolute temperature and of the current inversely proportional to absolute temperature. The output module is connected to the feedback stage.

In yet another aspect embodiments of the present invention provide for an integrated circuit comprising a power supply terminal, a ground terminal, and a first circuit configured to generate a current proportional to absolute temperature. The first circuit includes a first processing circuit connected to terminals of a core circuit and configured to equalize voltage across the terminals of the core circuit. The first processing circuit includes a first amplifier having a first stage, biased on the basis of the current inversely proportional to absolute temperature, arranged according to a folded setup and comprising first PMOS transistors arranged in a common-gate setup, and a feedback stage having an input connected to the output of the amplifier and having an output connected to the input of the first stage and to a terminal of the core. The feedback stage is configured to be traversed by an intermediate current equal to the sum of the current proportional to absolute temperature and of the current inversely proportional to absolute temperature. The second circuit is configured to generate a current inversely proportional to absolute temperature, and is connected to the core. _An output module is connected to the feedback stage and configured to output the reference voltage.

BRIEF DESCRIPTION OF THE DRAWINGS

Other advantages and characteristics of the invention, making it possible in particular to improve the stability of the output signal while increasing the gain, will be apparent on examining the detailed description of wholly non-limiting embodiments and modes of implementation and the appended drawings in which.

DETAILED DESCRIPTION OF ILLUSTRATIVE EMBODIMENTS

Figure 1:
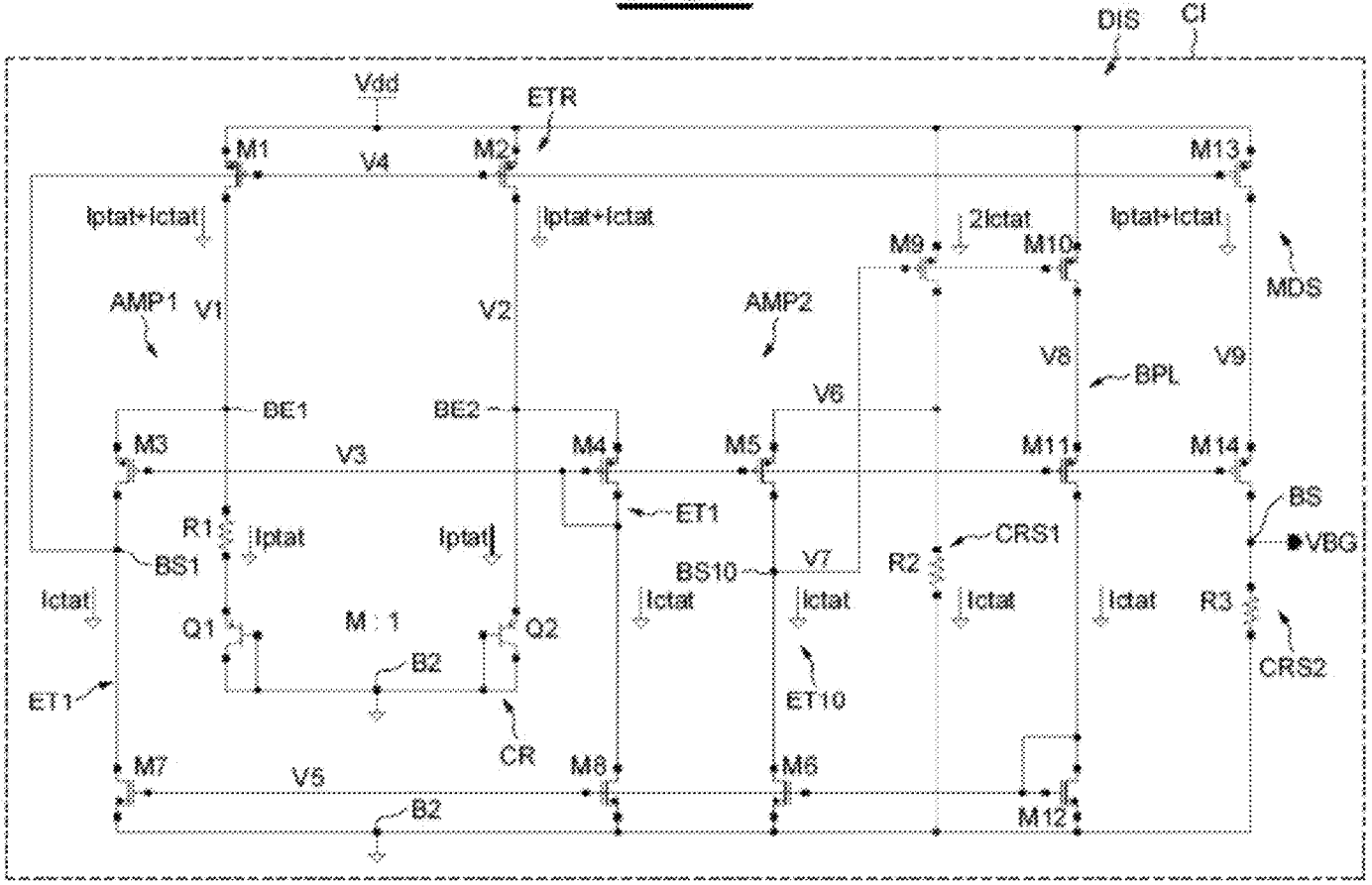
FIGS. 1 to 3 schematically illustrate various embodiments of a generating device according to the invention allowing various modes of implementation of the method according to the invention.

Before addressing the illustrated embodiments in detail, various embodiments and advantageous features thereof will be discussed generally in the following paragraphs.

According to one embodiment, there is proposed a generator of a reference voltage of the bandgap type capable of operating under a low power supply voltage, with a reduced silicon area, and exhibiting a large PSRR parameter ("Power Supply Rejection Ratio"). It is recalled that the PSRR parameter is the ratio of the variation of the power supply voltage to the corresponding variation of the bandgap voltage delivered.

According to one aspect, there is proposed a device for generating an adjustable bandgap reference voltage comprising first means for generating a current proportional to absolute temperature comprising first processing means connected to the terminals of a core and designed to equalize the voltages across the terminals of the core, second means for generating a current inversely proportional to absolute temperature connected to the core, and an output module designed to generate the reference voltage.

Of course the person skilled in the art is aware that the character proportional to absolute temperature of the internal current flowing in the core depends in particular on the proper equalization of the voltages across the terminals of the core, this equalization possibly being better or worse as a function in particular of the technological vagaries related to the method of manufacture of the components possibly leading to mismatches of transistors, for example, or else of internal offsets in voltages.

A current proportional to absolute temperature is therefore understood here as a current proportional or substantially proportional to absolute temperature, especially taking account of technological inaccuracies and/or of possible voltage offsets for example.

Likewise, a CTAT current is a current inversely proportional to absolute temperature or substantially inversely proportional to absolute temperature, especially taking account likewise of technological inaccuracies.

According to a general characteristic of this aspect, the first processing means comprise a first amplifier possessing at least one first stage, biased on the basis of the current inversely proportional to absolute temperature, arranged according to a folded setup and comprising first PMOS transistors arranged according to a common-gate setup; the first processing means also comprise a feedback stage whose input is connected to the output of the amplifier and whose output is connected to the input of the first stage as well as to at least one terminal of the core, the feedback stage being intended to be traversed by an intermediate current equal to the sum of the current proportional to absolute temperature and of the current inversely proportional to absolute temperature, and the output module is connected to the feedback stage.

Thus, according to this aspect, the first stage of the first amplifier arranged in folded mode is biased on the basis of the current inversely proportional to absolute temperature generated by the second generating means, thereby allowing the flow, in the feedback stage of the first amplifier, of a current equal to the sum of the current proportional to absolute temperature and of the current inversely proportional to absolute temperature.

Therefore, through this structure, the use of duplicate considerable lateral resistors is avoided, thereby allowing a saving of space while offering very low current consumption since, in addition to the economy of resistance, the branches of the first stage which divert the Ictat current also serve as amplifier.

The common-gate setup (in which the input signal drives the source of a MOS transistor) which is distinguished from a common-source setup (in which the signal drives a gate of a MOS transistor) makes it possible to decrease the input impedance since a source instead of a gate is driven, thereby making it possible in particular to improve the PSRR parameter.

Moreover, a folded setup of the first stage of the amplifier, in which the branches containing the PMOS transistors are connected between the terminals of the core and a reference voltage, for example earth, is distinguished from a stacked setup in which the transistors of the first stage are stacked with the transistors of the feedback stage and the transistors of the core, and thus makes it possible to operate under a minimum power supply voltage equal to the sum of a drain-source voltage of a MOS transistor and of a diode voltage, i.e. about 0.9 volts. The use of PMOS transistors also allows a bias of the first stage "through the bottom", that is to say a flow of the bias current towards earth.

Furthermore, the use of PMOS transistors mounted in common gate fashion, which require for their operation a negative gate-source voltage Vgs, helps with being able to operate the device under the minimum voltage of the power supply mentioned hereinabove.

According to one embodiment the second generating means comprise a follower amplifier setup connected to a terminal of the core.

Thus, the voltage inversely proportional to absolute temperature available at a terminal of the core is recovered, by the follower amplifier setup, so as to bias the first stage of the first amplifier on the basis of the corresponding current inversely proportional to absolute temperature.

Several structures of follower amplifier setup are possible. It is for example possible to envisage a follower amplifier setup, connected to a terminal of the core and separate from the first amplifier, comprising a second amplifier of conventional structure, for example of the type with common source, and a feedback transistor connected between the output of the second amplifier and the positive input of the second amplifier.

That said, it is particularly advantageous for the follower amplifier setup to comprise a second amplifier possessing at least one first stage, also biased on the basis of the said current inversely proportional to absolute temperature, comprising second PMOS transistors arranged according to a common-gate setup, the first stage of the second amplifier having a part common with the first stage of the first amplifier, and a feedback transistor connected between the output of the second amplifier and an input of the second amplifier.

The fact of having a common part for the first stages of the two amplifiers makes it possible to decrease the current consumption and to improve the matching between the two amplifiers.

Moreover the use for the first stage of the second amplifier of PMOS transistors in a common-gate setup confers the same advantages as those indicated hereinabove for the first stage of the first amplifier.

Furthermore, the fact that the first stages of the two amplifiers have a common part makes it possible to have a folded setup for the first stage of the second amplifier. Therefore, not only can the device as a whole operate under a minimum power supply voltage equal to the sum of a drain-source voltage of a MOS transistor and of a diode voltage, i.e. about 0.9 volts, but this minimum power supply voltage will follow technological trends and drop below 0.9 volts if the value of the drain-source voltage of a MOS transistor and/or of a diode voltage decreases. This would not necessarily have been the case for a second conventional follower amplifier in a common-source setup totally separate from the first amplifier, which may require a power supply voltage greater than the power supply voltage corresponding to the technology used, if the latter power supply voltage is too low.

Although various types of architectures are possible, in particular a feedback connected to a single terminal of the core, it is preferable that the first amplifier be a differential-input single-output amplifier, and that the feedback stage be a single-input differential-output feedback stage. A differential-differential global architecture such as this makes it possible to have good equality between the currents flowing in the two transistors (diodes) of the core and therefore better linearity in relation to temperature of the current proportional to absolute temperature.

According to one embodiment, a bias loop is connected between the second generating means and the respective first stages of the first amplifier and of the second amplifier, and is designed to bias each of these first stages on the basis of the current inversely proportional to absolute temperature.

According to one embodiment, the said first amplifier comprises an inverter stage arranged in a setup of the common-source type, and connected between the output of the first stage and the input of the feedback stage, the output of the inverter stage forming the output of the amplifier and the said second amplifier comprises an inverter stage arranged in a setup of the common-source type, connected between the output of the first stage and the gate of the feedback transistor.

The addition of such inverter stages makes it possible in particular to increase the span of possible values for the power supply voltage, and to further improve the PSRR parameter, especially if the gain is considerable.

According to another aspect, there is proposed an integrated circuit comprising a device such as defined hereinabove.

According to another aspect, there is proposed a method for generating an adjustable bandgap reference voltage, comprising a generation of a current proportional to absolute temperature comprising an equalization of the voltages across the terminals of a core designed to then be traversed by the said current proportional to absolute temperature, a generation of a current inversely proportional to absolute temperature, a summation of these two currents and a generation of the said bandgap reference voltage on the basis of the said sum of currents.

According to a general characteristic of this aspect, the said equalization comprises a connection across the terminals of the core of a first fed-back amplifier possessing at least one first stage arranged as a folded setup and comprising first PMOS transistors arranged according to a common-gate setup, and a biasing of the said first stage on the basis of the said current inversely proportional to absolute temperature, the said summation of the two currents being performed in the feedback stage of the first amplifier.

According to one mode of implementation, the said current inversely proportional to absolute temperature is generated by using a second fed-back amplifier possessing at least one first stage having a part common with the first stage of the first amplifier and the first stage of the second amplifier is also biased on the basis of the said current inversely proportional to absolute temperature.

It is possible to bias the first stage of the first amplifier and the first stage of the second amplifier with the said current inversely proportional to absolute temperature or with a fraction of this current inversely proportional to absolute temperature.

Turning now to the illustrated embodiments. In FIG. 1, the reference DIS designates a device for generating a bandgap voltage VBG. This device DIS is for example produced in a manner integrated within an integrated circuit CI. The device DIS comprises a core CR designed so as, when the voltages V1 and V2 at its two terminals BE1 and BE2 are equalized, to be traversed by an internal current Iptat proportional to absolute temperature.

Here the core CR comprises a first PNP bipolar transistor, referenced Q1, mounted in diode fashion and connected in series with a resistor R1 between the input terminal BE1 and a terminal B2 linked to a reference voltage, here earth.

The core CR also comprises a PNP bipolar transistor referenced Q2, also mounted in diode fashion, and connected in series between the second terminal BE2 of the core and the terminal B2 linked to earth.

The size of the transistor Q1 and the size of the transistor Q2 are different, and are in a ratio M in such a way that the density of current passing through the transistor Q1 is different from the density of current passing through the transistor Q2. Of course it would also be possible to use a transistor Q2 and M transistors Q1 in parallel, all of the same size as that of the transistor Q2.

As is well known to the person skilled in the art, when the voltages V1 and V2 are equal or substantially equal, the internal current Iptat passing through the resistor R1 is then proportional to absolute temperature and equal to KTLog (M)/qR1, where K denotes Boltzmann's constant, T the absolute temperature, q the charge of an electron, and Log the Napierian logarithm function.

The device also comprises a first amplifier AMP1 here possessing a first stage ET1 arranged in common-gate setup and in folded setup. The amplifier AMP1 is fed back by a feedback stage ETR connected between the output BS1 of the first stage ET1, and therefore of the amplifier AMP1, and the differential input BE1, BE2 of the first stage which also forms the two terminals of the core CR. The fed-back amplifier is thus designed to equalize the voltages V1, V2 at the terminals BE1, BE2 of the core CR.

The first stage ET1 of the amplifier AMP1, which here is a stage with differential input and single output, here comprises a differential pair of branches comprising a pair of PMOS transistors M3, M4 mutually connected by their gate. These two PMOS transistors are in common-gate setup, their respective sources, receiving the input signal, being connected to the two input terminals BE1, BE2. The voltages across the terminals BE1, BE2 are of the order of 500 mV to 800 mV throughout the span of temperatures.

The transistor M4 is mounted in diode fashion, its drain being linked to its gate. The voltage V3 across the terminals of the gates of the transistors M3 and M4 is equal to V2 minus the gate-source voltage of M4. At the lowest it is equal to the drain-source saturation voltage of the transistor M8, i.e. of the order of 100 millivolts.

The voltage Vgs across the terminals of the transistors M3 and M4 is consequently negative and compatible with the operation of a PMOS transistor. The drain of the transistor M3 here forms the output terminal BS1 of the first stage ET1.

The first stage ET1 also comprises two NMOS bias transistors, M7 and M8, mutually connected by their gate. The transistor M7 is connected in series between the drain of the transistor M3 and the terminal B2 linked to earth, and the transistor M8 is connected in series between the drain of the transistor M4 and the terminal B2.

The feedback stage ETR, arranged in common source setup, comprises a pair of PMOS transistors, M1, M2 mutually connected by their gate. The PMOS transistor M1 has its source connected to the terminal B1 linked to a power supply voltage Vdd, and its drain connected to the terminal BE1.

The PMOS transistor M2 also has its source connected to the power supply terminal B1 and its drain connected to the terminal BE2 of the core.

The voltage output terminal BS1 of the stage ET1 is connected to the input (gate of the transistors M1 and M2) of the stage ETR. The feedback stage is therefore here a single-input differential-output stage, thereby making it possible to obtain a completely differential global architecture.

The device DIS also comprises a follower amplifier setup comprising a second operational amplifier AMP2. The second amplifier AMP2 comprises a first stage ET10 comprising a differential pair of branches here comprising a pair of PMOS transistors M4, M5 mutually connected by their gate.

The source of the transistor M4 is linked to the terminal BE2 of the core CR while the drain of the transistor M5 forms the output terminal BS10 of the first stage ET10 and is connected to the gate of a feedback transistor M9 whose drain is connected to the source of the transistor M5.

The sources of the transistors M4 and M5 therefore here form a differential input and the aim of this amplifier AMP2 is to equalize the voltages V2 and V6 respectively present at the differential input of the first stage ET10.

The first stage ET10 also comprises two NMOS bias transistors M8 and M6, mutually connected by their gate. The transistor M6 is connected in series between the drain of the transistor M5 and the terminal B2.

It is therefore seen here that the PMOS transistors M4 and M5 are also arranged according to a common-gate setup. Moreover, the first stage ET10 of the second amplifier AMP2 has a part in common, in this instance the branch M4, M8, with the first stage ET1 of the first amplifier AMP1. The first stage ET10 of the amplifier AMP2 is also arranged according to a folded setup.

A first resistive circuit CRS1, here comprising a resistor R2, is connected in series between the drain of the feedback transistor M15 and earth (terminal B2).

The second amplifier AMP2 fed back by the feedback transistor M9, as well as the first resistive path CRS1, form second means for generating a current Ictat inversely proportional to absolute temperature.

The device DIS also comprises a bias loop BPL connected between the second generating means, and more particularly the gate of the feedback transistor M9, and the first stages ET1 and ET10. The bias loop BPL here comprises the feedback transistor M9, as well as a first additional transistor M10 whose gate is connected to the gate of the feedback transistor M9.

The source of the transistor M10 is connected to the power supply terminal B1, the size (channel width W/channel length L) of each of the transistors M9 and M10 is identical so that the transistors M9 and M10 form first current-copying means, so that the current passing through the transistor M10 is equal to the current passing through the transistor M9.

In addition to a transistor M11, the function of which will be returned to in greater detail hereinafter, the bias loop also comprises current mirrors formed by the bias transistors M6, M7, M8 and by a transistor M12 mounted in diode fashion and connected in series between the transistor M11 and the terminal B2 linked to earth.

The device DIS also comprises an output module MDS here comprising second current-copying means formed by the PMOS transistors M1, M2 of the feedback stage, and by a second PMOS additional transistor, referenced M13. The gate of this transistor M13 is connected to the gate of the transistors M1, M2 and its source is linked to the power supply terminal B1. Its drain is linked to the output terminal BS of the device by way of a transistor M14, the function of which will be returned to in greater detail hereinafter.

Although the ratio of the size of the transistor M13 to the size of the transistors M1, M2 may be arbitrary, the size of the transistor M13 is here taken equal to the size of the transistor M2 (equal to the size of the transistor M1) in such a way that the second copying means M1, M2, M13 deliver a copied current equal to the intermediate current flowing in the feedback stage.

The output module MDS also comprises a second resistive path CRS2 comprising a resistor R3 here connected between the output terminal BS and earth (terminal B2).

In the steady state, that is to say when the voltages V1 and V2 are equalized or almost equalized, the core CR is traversed by the internal current Iptat. Moreover, the voltage V2 available at the terminal BE2 of the core is a CTAT voltage, that is to say a voltage inversely proportional to absolute temperature.

Through the common-gate approach, the two fed-back amplifiers can also be considered to be a feedback loop which regulates the voltages V4 (output voltage of the first stage ET1) and V7 (output voltage of the first stage ET10) so as to obtain the following equalities between the following currents:

$$I_{M1}=I_{M2}=I_{M3}+I_{R1}$$

$$I_{M1}=I_{M5}+I_{R2}$$

As indicated hereinabove, the second amplifier AMP2, fed back by the feedback transistor M9, equalizes the voltages V2 and V6 present at these two inputs with the value of the voltage V2. Consequently, the current passing through the feedback transistor M9 and consequently the resistor R2 of the first resistive path CRS1, is the current inversely proportional to absolute temperature Ictat=V2/R2.

This current is copied in the branch M10, M11, M12 of the bias loop BPL by way of the first current-copying means formed by the transistors M9 and M10. This current is moreover copied in the branches of the differential pair of the first stage ET1 of the first amplifier AMP1 by way of the transistors M7, M8, M12, of the same size, and which consequently form a current mirror.

This current is also copied in the branches of the differential pair of the first stage ET10 of the second amplifier AMP2 by way of the transistors M6, M8, M12, of the same size, and which consequently form a current mirror.

Thus the first stage ET1 and the first stage ET10 are both biased with the current Ictat. Consequently, the intermediate current which flows in the feedback stage ETR of the first amplifier AMP1, that is to say through the transistors M1 and M2, is, on account of the folded setup of the first stage, the sum of the current Iptat flowing in the core CR and of the current Ictat.

This intermediate current Iptat+Ictat is equal to $$\frac{kT\mathrm{Log}M}{qR1}+\frac{V2}{R2},$$

This intermediate current is thereafter copied in the second resistive layout CRS2 of the output module MDS by the second current-copying means formed by the transistors M1, M2 and M13, all three of which are, in this embodiment, the same size.

Consequently, this copied current is here equal to the intermediate current flowing in the feedback stage.

Because of the presence of the resistor R3, the output voltage VBG is equal to $$\frac{R3}{R2}\left(V2+\frac{R2kT}{R1q}\mathrm{Log}M\right).$$

By correctly choosing the ratio R2/R1, the temperature dependent coefficient of the voltage VBG may be zeroed for a given temperature, for example 27° C., and the value of the voltage VBG is then considered to be independent of absolute temperature for this given temperature, that is to say it will vary very little in a span of temperatures around this given temperature. The value of the resistor R3 makes it possible to adjust the value of the voltage VBG.

Although not indispensable, the auxiliary transistors M11 and M14, whose gates are connected to the gates of the transistors M3, M4 and M5, form respectively, with the transistors M10 and M14, two cascode setups. The presence of the first cascode transistor M11 makes it possible to obtain good equality between the drain voltage V8 of the transistor M10 and the voltage V6 present at an input of the second amplifier AMP2, thereby guaranteeing very good copying of current at the level of M9-M10.

The PSRR parameter of the output voltage VBG depends on the power supply rejection at the level of the resistive path CRS2 and the power supply rejection of the intermediate current Iptat+Ictat flowing in the feedback stage ETR.

The power supply rejection in the resistive path CRS2 is improved by the addition of the cascode transistor M14. On account of the cascode transistor M14, generally R3 is chosen so as to be able to obtain a value of the voltage VBG which is strictly less than the minimum of the voltage V2 over the temperature span. If the cascode transistor M14 is removed, it is possible to choose R3 so as to be able to obtain a value of the voltage VBG which is higher (up to Vdd−VDSSAT where VDSSAT designates the drain-source saturation voltage of the transistor M13), but at the price of a deterioration in the PSRR parameter.

The power supply rejection of the intermediate current is also improved by the fact that the PMOS transistors of the stage ET1 are arranged in a common-gate setup. Indeed, the impedance at the terminals BE1 and BE2 is then significantly reduced, thereby making it possible to increase the PSRR parameter.

Moreover, the feedback divides this impedance by a factor equal to 1 plus the open-loop gain, thereby further improving the PSRR parameter.

Finally, the consumption of the device is reduced because of the presence of a common part between the first two stages of the two amplifiers.

The device of FIG. 1 exhibits a temperature-variable voltage offset between the terminals BE1 and BE2 (on the voltages V1 etV2), because of the non-equality between the drain voltages V3 etV4 of the transistors M3 and M4. This may be an impediment in certain applications. So as to remedy this while increasing the span of possible values for the power supply voltage Vdd as well as the PSRR rate, it is possible to use the embodiment of the device DIS illustrated in FIG. 2.

Figure 2:
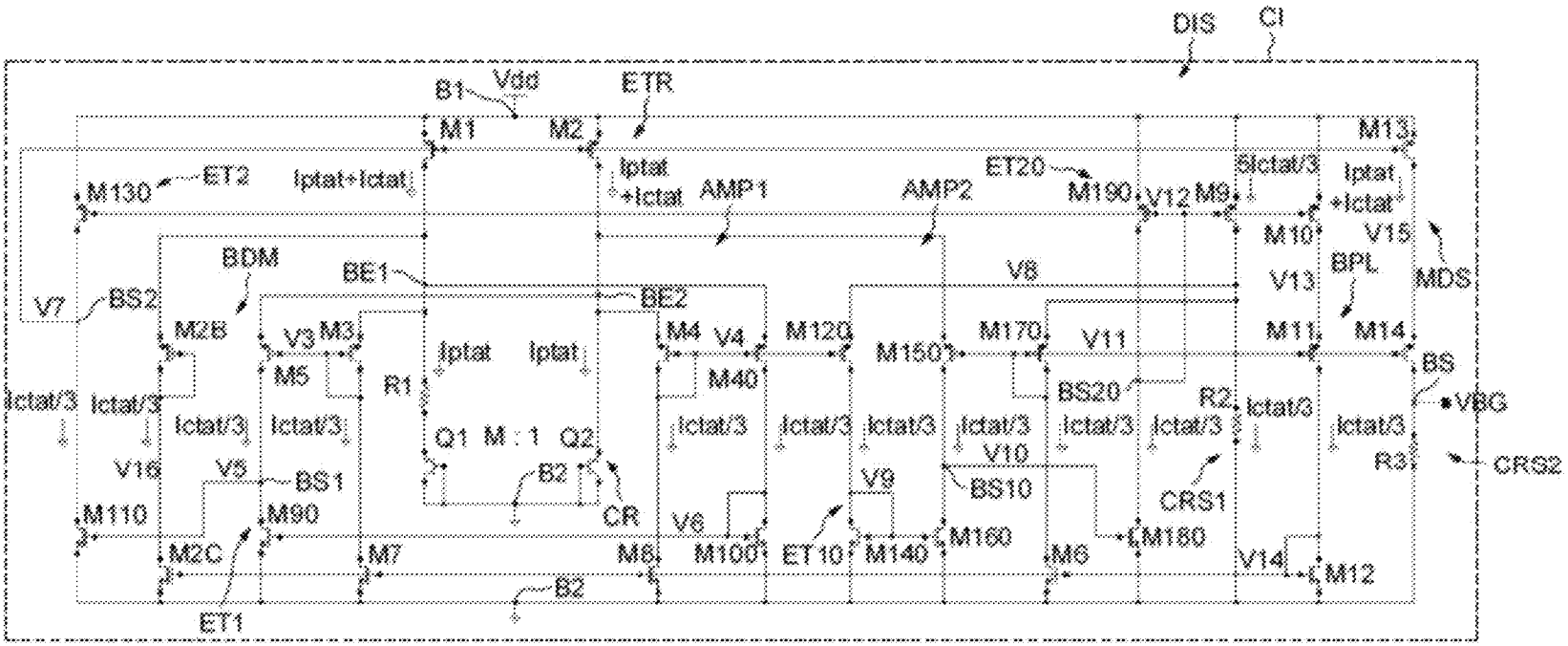

Relative to the previous embodiment, the first stage ET1 of the amplifier AMP1 of the device DIS illustrated in FIG. 2 has a different structure, but still exhibiting a folded arrangement as a common-gate setup. More precisely, the first stage ET1 comprises a first differential pair of branches connected between the two terminals BE1 and BE2 of the core and the reference terminal B2 (earth), this first differential pair of branches comprising a first pair of PMOS transistors M3 and M4.

The first stage ET1 moreover comprises a second differential pair of branches connected in a crossed manner between the two terminals BE1 and BE2 of the core, and the reference voltage (terminal B2), this second differential pair of branches comprising a second pair of PMOS transistors M5 and M40.

The transistors M3 and M4 of the first pair of transistors are mounted in diode fashion, their drain being connected to their gate. Moreover, the gate of the transistor M5 is linked to the gate of the transistor M3 and the gate of the transistor M40 is linked to the gate of the transistor M4. The doublet of homologous transistors M3, M5 of the two pairs therefore forms a pseudo-current mirror, just like the doublet of the homologous transistors M4, M40 of the two pairs.

Each doublet forms a pseudo-current mirror since the sources of the two transistors of each doublet are different. This being so, the equality of the currents flowing in the two transistors of each doublet stems from the fact that the device equalizes the sources of the two corresponding transistors in the steady state, that is to say when the voltages V1 and V2 are equalized or almost equalized. A copied current is then obtained and each doublet of transistors then behaves functionally as a current mirror. Each doublet may therefore be said to form a pseudo-current mirror structurally and a current mirror functionally.

The first differential pair of branches includes the two NMOS bias transistors, referenced M7 and M8, respectively connected in series with the PMOS transistors M3 and M4.

The second differential pair of branches comprises a first supplementary NMOS transistor M90 and a second supplementary transistor M100, the latter being mounted in diode fashion, whose gates are mutually connected, and together forming a current mirror.

The drain of the first supplementary NMOS transistor referenced M90 is connected to the drain of the PMOS transistor M5 and its source is linked to earth (terminal B2). Likewise, the drain of the supplementary NMOS transistor referenced M100 is connected to the drain of the transistor M40 and its source is linked to the terminal B2.

Furthermore, relative to the embodiment of FIG. 1, the amplifier AMP1 of the device DIS here comprises an inverter stage ET2 arranged in a setup of the common-source type (the output signal of the first stage drives the gate of a MOS transistor), this inverter stage being connected between the output BS1 of the first stage ET1, formed by the drain of the first PMOS transistor M5, and the input of the feedback stage ETR, the output BS2 of the inverter stage forming the output of the amplifier AMP1.

The inverter stage ET2 here comprises a first NMOS transistor M110 as well as a PMOS transistor M130. The source of the NMOS transistor M110 is linked to the reference terminal B2 (earth) while the source of the PMOS transistor M130 is linked to the power supply terminal B1.

The drains of the transistors M110 and M130 are linked together and form the output BS2 of the inverter stage ET2. This output BS2 is linked to the gate of the transistors M1, M2, M13.

The size (ratio W/L where W denotes the width of the channel and L the length of the channel) of the supplementary NMOS transistor M10 is equal to the size of the first NMOS transistor M11 of the inverter stage ET2 whose gate is connected to the output BS1 of the stage ET1. Here again, the stage ET1 is, in this embodiment, a differential-input single-output stage while the inverter stage ET2 is a single-input single-output stage.

The first stage ET10 of the second amplifier AMP2 comprises, in addition to the two branches M4, M8 and M40, M100, that are common with the first stage ET1 of the amplifier AMP1, three other branches. More precisely, a first branch connected between the drain of the feedback transistor M9 and the terminal B2 (earth) comprises a PMOS transistor M120, whose gate is connected to the PMOS transistors M4 and M40, and which is connected in series with an NMOS transistor M140 mounted in diode fashion.

A second branch of the stage ET10 is connected between the terminal BE2 of the core CR and the terminal B2, and comprises a PMOS transistor M150 connected in series with an NMOS transistor M160. The NMOS transistors M140 and M160 here form a current mirror.

A third branch of the stage ET10 is connected between the drain of the feedback transistor M9 and the terminal B2, and incorporates a PMOS transistor M170 mounted in diode fashion, whose gate is connected to the gate of the PMOS transistor M150. This PMOS transistor M170 is connected in series with the NMOS bias transistor M6. The transistors M150 AND M170 also form a pseudo-current mirror. The drain of the transistor M150 forms the output terminal BS10 of the first stage ET10.

Consequently, it is therefore seen here that the first stage ET10 of the second amplifier also comprises a differential pair of branches connected in a crossed manner between on the one hand, the terminal BE2 of the core, and the output of the feedback transistor M9, and on the other hand, the reference voltage present at the terminal B2.

So that the number of branches respectively connected to the two terminals BE1 and BE2 of the core are equal, the first processing means here comprise a dummy branch BDM connected between the terminal BE1 and the terminal B2 and also connected to the bias loop BPL.

This dummy branch, which does not participate in the actual operation of the amplifier AMP1, comprises a first dummy PMOS transistor M2B, mounted in diode fashion, and connected in series with an NMOS bias transistor M2C whose gate is connected to the bias transistors M7, M8 and M6 as well as to the transistor M12 of the bias loop BPL. Therefore, three branches are connected to the terminal BE1 and three branches are connected to the terminal BE2. The circuit is thus balanced.

The second amplifier AMP2 also comprises an inverter stage ET20 comprising an NMOS transistor M180 connected in series with a PMOS transistor M190. The source of the PMOS transistor M190 is connected to the terminal B1 and the source of the NMOS transistor M180 is connected to the terminal B2. The common drains of the transistors M180 and M190 form the output terminal BS20 of the amplifier AMP2.

This output terminal is connected to the gate of the feedback transistor M9 as well as to the gate of the transistor M190. The transistor M190 is consequently here mounted in diode fashion, thereby conferring a relatively low gain on the inverter stage ET20. Moreover, the size (ratio W/L) of the NMOS transistor 140 of the stage ET10 is equal to the size of the NMOS transistor 150 of the stage ET20.

The size of the feedback transistor M9 is here five times as large as the size of the transistor M190 of the stage ET20 and of the transistor M10 of the bias loop BPL. Consequently, having regard to the various current mirrors, pseudo-current mirrors and the bias loop, whereas the current Ictat flows in the resistor R2 in the steady state, a current equal to 5 Ictat/3 flows in the transistor M9 while a current equal to Ictat/3 flows in the stage ET20 and in the branch M10, M11 of the bias loop.

On account of the presence of the transistors M12, M6, M7, M8 and M2C, the bias loop BPL makes it possible to cause a bias current equal to Ictat/3 to flow in the branch M6, M70, in the branch M8, M4, in the branch M7, M3, and in the dummy branch BDM.

Moreover, the pseudo-current mirror M150, M170 and the current mirror M140, M160 make it possible to cause a current Ictat/3 to flow in the branch M120, M140, and in the branch M150, M160.

Likewise, the pseudo-current mirrors M4, M40 and M3, M5 make it possible to cause a current equal to Ictat/3 to flow in the branch M40, M100 and in the branch M5, M90. Consequently, the intermediate current flowing in the feedback stage ETR is still equal to Iptat+Ictat.

The size of the transistor M130 of the stage ET2 also being five times smaller than the size of the transistor M9, a current Ictat/3 also flows in the stage ET2.

Although the transistor M190 of the stage ET20 is arranged in diode fashion, the span of admissible values for the power supply voltage is higher than in the embodiment of FIG. 1, since the dynamic swing in the voltage V7 (terminal BS2) is greater than the dynamic swing of the voltage V4 (terminal BS1) of the device of FIG. 1 which follows the increase in the power supply voltage Vdd leading ultimately to pinch-off of the drain-source voltage of the transistor M3 of the device of FIG. 1.

Indeed, in the embodiment of FIG. 2, when the power supply voltage increases, the voltage V7 increases, but the voltage V5 remains fixed since this voltage drives the gate of an NMOS transistor (the transistor M110) referenced to earth.

By way of indication, whereas the span of possible variations of the power supply voltage Vdd is of the order of 300 millivolts for the device of FIG. 1, it extends between about 0.9 volts and the value of the breakdown voltage of the transistors for the device of FIG. 2.

Moreover, since the voltage V5 (drain of the transistor M5) drives the gate of an NMOS transistor, in this instance the transistor M110 of the stage ET2, while the voltage V6 (drain of the transistor M40) also drives the gate of an NMOS transistor, in this instance the transistor M100 of the current mirror M90, M100 and, since the size of the transistors M110 and M100 is identical and these two transistors are traversed substantially by the same current, namely the current Ictat/3, there is quasi-equality of the voltages V5 and V6 and consequently an appreciable reduction in the offset at the level of the voltages V1 and V2.

It should be noted here that the current mirror M90, M100 also makes it possible to recover the differential and actually allows a single output for the first stage ET1.

Likewise since the voltage V10 (drain of the transistor M150) drives the gate of an NMOS transistor, in this instance the transistor M180 of the stage ET20, while the voltage V9 (drain of the transistor M120) also drives the gate of an NMOS transistor, in this instance the transistor M140 of the current mirror M140, M160 and, since the size of the transistors M140 and M180 is identical and these two transistors are traversed substantially by the same current, namely the current Ictat/3, there is quasi-equality of the voltages V9 and V10 and consequently an appreciable reduction in the offset at the level of the voltages V2 and V8.

An offset persists moreover on account of the inequality between the voltages V7 and V12, but its impact is divided by the gain of the stage ET2 and of the stage ET20. Furthermore in a particular example, at 27° C., V7=V12 since at this temperature Iptat-Ictat and the size of M1, M2 and M13 has been chosen so as to satisfy this equality. Therefore, the offset is very low over the whole of the span −40° C. to 125° C.

It will also be noted that the first stage ET10 of the second amplifier AMP2 is also a differential-input single-output stage, the current mirror M140, M160 making it possible to recover the differential and to create the single-output voltage V10.

Moreover, this embodiment makes it possible to further increase the PSRR parameter because of the crossed coupling of the differential pairs of branches which allow an increase by two in the gain.

Moreover, the presence of the second inverter stages ET2 and ET20 in the device of FIG. 2 allows an increase in the open-loop gain (even if this increase is diminished having regard to the low gain of the inverter stage ET20), thereby tending to an improvement in the PSRR parameter.

That said, because of the presence in the embodiment of FIG. 2 of second inverter stages ET2, ET20, stability problems may result with the output signal, giving rise to the presence in this signal of sustained oscillations. It may therefore be necessary, in certain applications, to compensate for these oscillations for example through the addition of capacitors.

Figure 3:
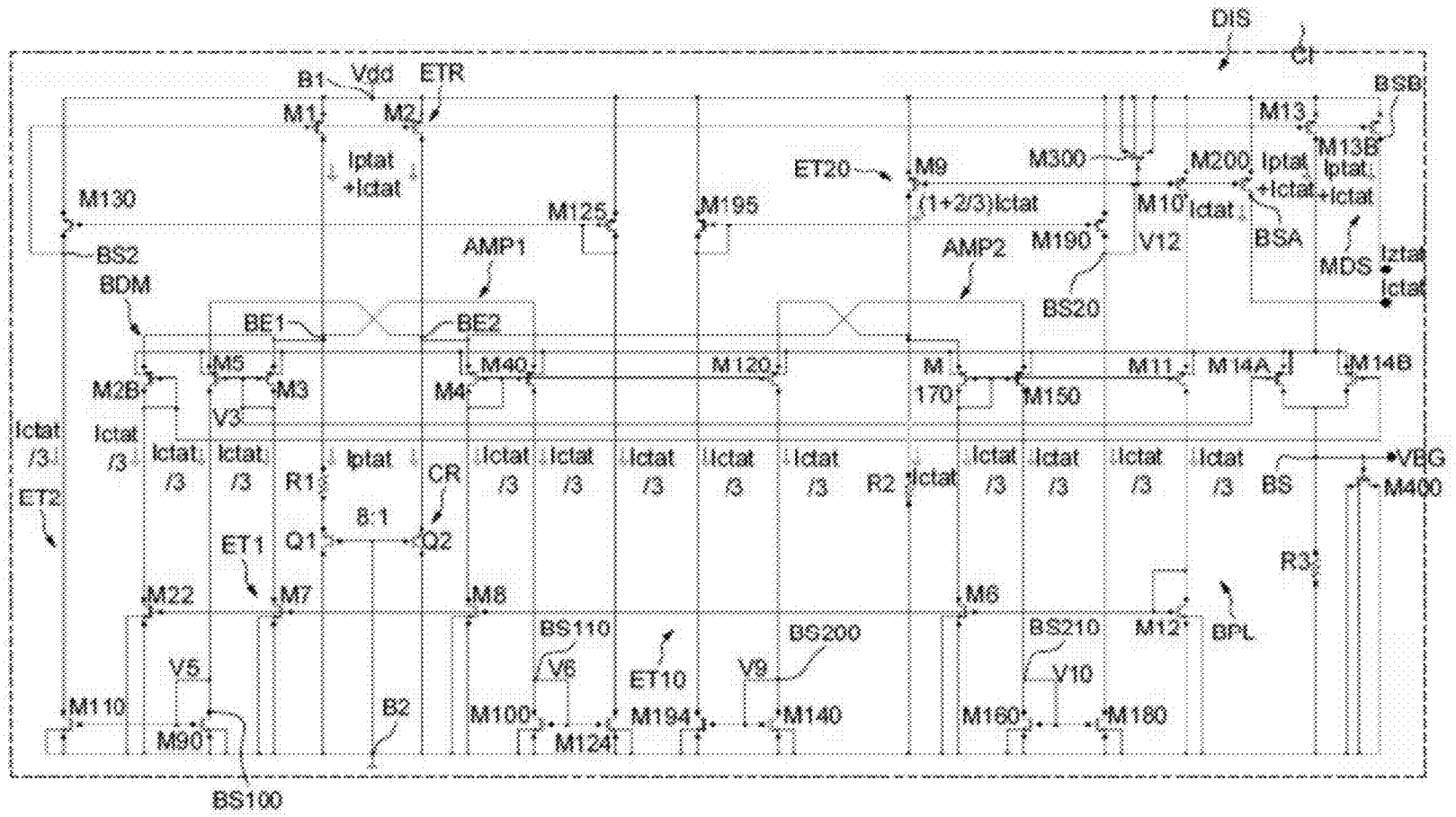

The embodiment of FIG. 3 makes it possible to continue to offer a greater span of values for the power supply voltage, while making it possible to more easily compensate for these oscillations. With respect to the embodiment of FIG. 2, this time the first stage ET1 of the amplifier AMP1 comprises not only the transistor M100 mounted in diode fashion but also the transistor M90. The transistor M90, mounted in diode fashion, forms with the NMOS transistor M110 of the inverter stage ET2, whose gate is linked to the drain of the transistor M90, a current mirror.

Moreover, in this embodiment, the inverter stage ET2 comprises a second branch comprising an NMOS transistor M124 and a PMOS transistor M125 mounted in diode fashion, connected in series between the power supply terminal B1 and the transistor M124 referenced moreover to earth (connection of the source to the terminal B2).

The gate of the transistor M125 is moreover linked to the gate of the PMOS transistor M130 of the stage ET2, these two transistors M125 and M130 thus forming a current mirror.

By analogy with the transistors M90 and M110, the transistors M100 and M124 form an NMOS current mirror, the gate of the transistor M124 being linked to the drain of the transistor M100.

This time the stage ET1 is a differential-input differential-output stage, the differential output BS100-BS110 of the first stage ET1 being formed by the drains of the transistors M90 and M100. Therefore, this time the inverter stage ET2 is a differential-input single-output stage.

As regards the stage ET10 of the second amplifier AMP2, in addition to the fact that here again it comprises a part common with the first stage ET1 of the first amplifier, it exhibits a different structure from that of FIG. 2.

More precisely, the transistor M160 connected to the transistor M150 is mounted in diode fashion and the respective drains of the transistors M140 and M160 form a differential output BS200-BS210 for this first stage ET10.

Moreover, the second inverter stage ET20 comprises, just like the second stage ET2, an additional branch connected between the terminals B1 and B2 and comprising a PMOS transistor M195 connected in diode fashion, and an NMOS transistor M194 whose gate is connected to the gate of the transistor M140 and consequently to its drain.

The transistors M194 and M140 consequently form a current mirror in the same way as the transistors M160 and M180. The gate of the transistor M195 is linked to the gate of the transistor M190 and these two transistors consequently form a current mirror. It will be noted here that in this embodiment the stage ET20 is a stage with differential input and single output BS20.

Moreover, this time the gain of the inverter stage ET20 is much greater than the gain of the stage ET20 of FIG. 2 since this time the transistor M190 is not mounted in diode fashion.

On account of the bias loop BPL and the various current mirrors and pseudo-current mirrors, a current Ictat/3 flows in each of the branches of the stages ET1, ET10, ET2 and ET20 as well as in the dummy branch BDM. Moreover, the size of the transistor M9 is five times as great as the size of the transistor M10, so that a current equal to 5 Ictat/3 passes through it in the steady state.

Relative to the structure of FIG. 2, the gain has not increased since the gain of the first stage ET10 is lower on account of the diode M160. On the other hand the gain being transferred to the inverter stage ET20, compensation for the instabilities is done more easily since the capacitive value at output is higher.

Moreover, in a manner analogous to what was explained hereinabove, the span of admissible values for the power supply voltage is considerable because of the considerable dynamic swing of the voltage V7 at the terminal BS2 while the voltage V5 remains fixed when the power supply voltage varies.

Moreover, as was explained hereinabove, here there is still a considerable reduction in the voltage offset between the various input voltages of the first two stages of the two amplifiers because of the equality of the voltages V5 and V6 which both drive MOS transistors of identical size traversed by one and the same current, namely the current Ictat/3, and of the equality of the voltages V9 and V10, which also both drive MOS transistors of identical size traversed by one and the same current, namely the current Ictat/3.

By way of indication, the value of the gain of the open-loop amplifiers of such a structure is of the order of 60 dB with a PSRR parameter of the order of 80 dB in the steady state (under DC: "Direct Current). The power supply voltage can vary between about 0.9 volts and the value of the breakdown voltage of the transistors.

On the other hand, in certain applications such a structure may require compensation because of the presence of the two gain stages if the capacitive value at the level of the gates of the transistors M1 and M2 is not sufficient. This compensation may be carried out between the power supply voltage Vdd and the voltage V12 by placing for example a capacitor (NMOS transistor M300) between the output terminal BS20 and the power supply terminal B1.

It will also be noted that a capacitor formed by an NMOS transistor M400 is connected between the output terminal BS of the device and the reference terminal B2. This capacitor makes it possible to create a VBG-based low-pass filter thereby improving the robustness to noise.

Moreover, it will also be noted that the cascode transistor M14 of FIG. 2 has been duplicated as two transistors M14A and M14B, in such a way that the gates of these two transistors M14A and M14B are connected to a substantially identical number of gates of NMOS transistors (in this instance the gates of the transistors M2B and M3 and M5), doing so in order to balance the stray capacitances of the circuit.

Finally, the output module MDS here comprises two other PMOS transistors, namely a transistor M200 and a transistor M13B. The gate of the transistor M200 is connected to the gates of the transistors M9 and M10. The size of the transistor M200 is three times as large as the size of the transistor M10, so that it is traversed, in the steady state, by the current Ictat. Thus, the device possesses a first additional output terminal BSA formed by the drain of the transistor M200, and delivering a reference current inversely proportional to absolute temperature.

Moreover, the output module MDS comprises another PMOS transistor M13B whose gate is connected to that of the PMOS transistor M13 and of identical size to that of the transistor M13. Consequently, in the steady state, the transistor M13B is traversed by a current Iztat which is the sum of the current Iptat and of the current Ictat.

The device DIS thus comprises a second additional output BSB capable of delivering a reference current independent of absolute temperature.

What is claimed is:

1. A method for generating an adjustable bandgap reference voltage, comprising:

generating a current proportional to absolute temperature, by equalizing a voltage across terminals of a core, the core configured to then be traversed by the current proportional to absolute temperature;

generating a current inversely proportional to absolute temperature;

summing the current proportional to absolute temperature and the current inversely proportional to absolute temperature; and generating the bandgap reference voltage on the basis of the sum of currents, wherein the equalizing comprises connecting a first fed-back amplifier across the terminals of the core, the first fed-back amplifier having a first stage comprising first PMOS transistors having conduction paths between the terminals of the core and a reference terminal and having a common-gate connection, the equalizing further comprising biasing the first stage on the basis of the current inversely proportional to absolute temperature;

wherein the summing is performed in a feedback stage of the first fed-back amplifier;

wherein the current inversely proportional to absolute temperature is generated by using a second fed-back amplifier having a first stage having a part common with the first stage of the first fed-back amplifier and wherein the first stage of the second fed-back amplifier is also biased on the basis of the current inversely proportional to absolute temperature; and wherein the first stage of the first fed-back amplifier and the first stage of the second fed-back amplifier are biased with the current inversely proportional to absolute temperature or with a fraction of the current inversely proportional to absolute temperature.

2. A device for generating an adjustable bandgap reference voltage, the device comprising:

first means for generating a current proportional to absolute temperature, the first means comprising first processing means connected to terminals of a core and designed to equalize the voltages across the terminals of the core;

second means for generating a current inversely proportional to absolute temperature connected to the core; and an output module designed to generate the reference voltage, wherein the first processing means comprise a first amplifier possessing at least one first stage, biased on the basis of the current inversely proportional to absolute temperature, arranged according to a folded setup and comprising first PMOS transistors arranged according to a common-gate setup, and a feedback stage whose input is connected to the output of the first amplifier and whose output is connected to the input of the first stage as well as to at least one terminal of the core, the feedback stage being intended to be traversed by an intermediate current equal to the sum of the current proportional to absolute temperature and of the current inversely proportional to absolute temperature, wherein the output module is connected to the feedback stage, wherein the second generating means comprise a follower amplifier setup connected to a terminal of the core, wherein the follower amplifier setup comprises a second amplifier having a first stage, also biased on the basis of the current inversely proportional to absolute temperature, comprising second PMOS transistors arranged according to a common-gate setup, the first stage of the second amplifier having a part common with the first stage of the first amplifier, and a feedback transistor connected between the output of the second amplifier and an input of the second amplifier, and wherein the first stage of the first amplifier comprises at least one differential pair of branches connected between the two terminals of the core and a reference voltage, the first stage of the second amplifier comprises at least one differential pair of branches having a branch in common with the at least one differential pair of branches of the first stage of the first amplifier, and the second generating means furthermore comprise a first resistive circuit connected in series with the feedback transistor, the first stage of the first amplifier comprises within a differential pair of branches, a pair of first NMOS bias transistors connected in series with a pair of first PMOS transistors, the first stage of the second amplifier comprises within a differential pair of branches, a pair of second NMOS bias transistors connected in series with a pair of second PMOS transistors.

3. The device according to claim 2, wherein the first amplifier is a differential-input single-output amplifier and the feedback stage is a single-input differential-output feedback stage.

4. The device according to claim 2, wherein a bias loop is connected between the second generating means and the respective first stages of the first amplifier and of the second amplifier, and is designed to bias each of these first stages on the basis of the current inversely proportional to absolute temperature.

5. The device according to claim 4, wherein the bias loop comprises the feedback transistor, a first additional transistor forming, with the feedback transistor, first current-copying means, and the pair of first NMOS bias transistors, and is designed to cause a flow, in each branch, of a bias current equal to the current inversely proportional to absolute temperature or to a fraction of this current inversely proportional to absolute temperature.

6. The device according to claim 5, wherein the feedback stage comprises a pair of third PMOS transistors mutually connected by their gate, wherein respective sources of the third PMOS transistors are connected to a power supply terminal, respective drains of the third PMOS transistors are linked to the two terminals of the core, and the output module comprising a second resistive circuit comprising a second additional PMOS transistor forming, with the third PMOS transistors of the feedback stage, second copying means configured to deliver, in the second resistive circuit, a copied current equal to the intermediate current or a multiple or sub-multiple of the intermediate current.

7. The device according to claim 6, further comprising a first auxiliary transistor forming with the first additional transistor a first cascode setup and at least one second auxiliary transistor forming with the second additional PMOS transistor of the second resistive circuit a second cascode setup.

8. The device according to claim 5, wherein the first stage of the first amplifier comprises a differential pair of branches connected in a crossed manner between the two terminals of the core and the reference voltage as well as first pseudo-current mirrors, the first stage of the second amplifier comprises a differential pair of branches connected in a crossed manner between on the one hand a terminal of the core and the output of the feedback transistor and on the other hand the reference voltage as well as second pseudo-current mirrors, and the first processing means comprise a dummy branch connected to the bias loop so that the numbers of branches respectively connected to the two terminals of the core are equal.

9. The device according to claim 2, wherein the first amplifier comprises an inverter stage arranged in a setup of the common-source type, and connected between the output of the first stage and the input of the feedback stage, the output of the inverter stage forming the output of the amplifier and the second amplifier comprises an inverter stage arranged in a setup of the common-source type, connected between the output of the first stage and a gate of the feedback transistor.

10. A device for generating an adjustable bandgap reference voltage, comprising:

first means for generating a current proportional to absolute temperature comprising first processing means connected to terminals of a core and designed to equalize the voltages across the terminals of the core;

second means for generating a current inversely proportional to absolute temperature connected to the core, wherein the second means comprise a second amplifier including at least one first stage and a feedback transistor; and an output module designed to generate the reference voltage, wherein the first processing means comprise a first amplifier including at least one first stage, biased on the basis of the current inversely proportional to absolute temperature, arranged according to a folded setup and comprising first PMOS transistors arranged according to a common-gate setup, and a feedback stage whose input is connected to the output of the first amplifier and whose output is connected to the input of the first stage as well as to at least one terminal of the core, the feedback stage being intended to be traversed by an intermediate current equal to the sum of the current proportional to absolute temperature and of the current inversely proportional to absolute temperature, and wherein the output module is connected to the feedback stage, wherein the first amplifier comprises an inverter stage arranged in a setup of the common-source type, and connected between the output of the first stage and the input of the feedback stage, the output of the inverter stage forming the output of the first amplifier, and the second amplifier comprises an inverter stage arranged in a setup of the common-source type, connected between the output of the first stage and the gate of the feedback transistor, and wherein the first stage of the first amplifier comprises a differential pair of branches connected in a crossed manner between two terminals of the core and the reference voltage as well as first pseudo-current mirrors, the first stage of the second amplifier comprises a differential pair of branches connected in a crossed manner between on the one hand a terminal of the core and the output of the feedback transistor and on the other hand the reference voltage as well as second pseudo-current mirrors, and the first processing means comprise a dummy branch connected to a bias loop so that the numbers of branches respectively connected to the two terminals of the core are equal, and wherein the inverter stage of the first amplifier and the inverter stage of the second amplifier respectively comprise two distinct current-copying means, each current-copying means being connected to two branches of the corresponding first stage by two current mirrors.

11. An integrated circuit comprising:

a power supply terminal;

a ground terminal;

a first circuit configured to generate a current proportional to absolute temperature, the first circuit including a first processing circuit connected to terminals of a core circuit and configured to equalize voltage across the terminals of the core circuit, the first processing circuit including a first amplifier having a first stage, biased on the basis of the current inversely proportional to absolute temperature, comprising first PMOS transistors having conduction paths between the terminals of the core circuit and the ground terminal and having a common-gate connection, and a feedback stage having an input connected to an output of the first amplifier and having an output connected to the input of the first stage and to a terminal of the core, the feedback stage being configured to be traversed by an intermediate current equal to the sum of the current proportional to absolute temperature and of the current inversely proportional to absolute temperature;

a second circuit configured to generate a current inversely proportional to absolute temperature, and being connected to the core, wherein the second circuit includes a follower amplifier setup connected to a terminal of the core, and wherein the follower amplifier setup comprises a second amplifier having a first stage, also biased on the basis of the current inversely proportional to absolute temperature, the second amplifier comprising second PMOS transistors arranged according to a common-gate setup, the first stage of the second amplifier having a part common with the first stage of the first amplifier, and a feedback transistor connected between the output of the second amplifier and an input of the second amplifier;

an output module connected to the feedback stage and configured to output a reference voltage; and wherein a bias loop is connected between the second circuit and the respective first stages of the first amplifier and of the second amplifier, and is designed to bias each of these first stages on the basis of the current inversely proportional to absolute temperature.

12. The integrated circuit according to claim 11, further comprising a logic circuit configured to receive the reference voltage output by the output module.

13. The integrated circuit according to claim 11, wherein the first amplifier is a differential-input single-output amplifier and the feedback stage is a single-input differential-output feedback stage.

* * * * *